US006505967B1

(12) United States Patent
Alfero-Kuronya

(10) Patent No.: US 6,505,967 B1
(45) Date of Patent: Jan. 14, 2003

(54) METAL CABINET CUTTINGS RECEPTACLE

(76) Inventor: Anthony E. Alfero-Kuronya, 297 Lenape Trail, Allentown, PA (US) 18104

( * ) Notice: Subject to any disclaimer, the term of this patent is extended or adjusted under 35 U.S.C. 154(b) by 0 days.

(21) Appl. No.: 09/636,073

(22) Filed: Aug. 10, 2000

(51) Int. Cl.[7] ..... B65D 33/14
(52) U.S. Cl. ..... 383/11; 383/33
(58) Field of Search ..... 383/11, 33; 248/99, 248/101; 220/495.08

(56) References Cited

U.S. PATENT DOCUMENTS 3,952,726 A * 4/1976 Hennig et al. ..... 600/30
4,205,678 A * 6/1980 Adair ..... 604/343
5,121,776 A * 6/1992 Kovach ..... 383/11 X
5,566,719 A * 10/1996 Kamiyama et al. ..... 138/98
5,735,227 A * 4/1998 Goulding ..... 114/227
5,967,200 A * 10/1999 Hall ..... 141/86

* cited by examiner

*Primary Examiner*—Jes F. Pascua
(74) *Attorney, Agent, or Firm*—Sanford J. Piltch, Esq.

(57) ABSTRACT

An apparatus for collecting cuttings, filings, and other particles by attaching a portable receptacle along an interior wall of a metal cabinet or container utilizing an array of magnets for temporary attachment to catch and retain the particles in a flexible receptacle or on a magnetic liner or a low density fabric.

7 Claims, 6 Drawing Sheets

METAL CABINET CUTTINGS RECEPTACLE

BACKGROUND OF THE INVENTION

The present invention relates to specialty receptacles. More specifically, the present invention is a flexible receptacle, e.g. a tightly woven cloth bag, which has a single opening attached to a planar support member that retains the bag in an open position and permits the bag to be placed directly against a metal surface through which a hole is to be punched, cut or drilled in order to catch whatever cuttings may be produced. The bag and support member is retained in position by a series of magnets affixed to the non-magnetic support member.

The planar support member to which the bag is affixed and retained in an open position may also be attached to and form part of an additional structure. The positioning and retaining member or structure may be described as having two planar members at right angles (90°) to each other with side supports therebetween having triangular shapes so as to prevent sideways escape of any metal cuttings. The support member, along one of its planar sides, has a pattern or array of magnets and a central hole, which is positioned over the area of the metal surface to be punched, cut, or drilled. The perpendicular planar member of the structure, to which the bag is attached, extends outward from the metal surface and has a fixed opening and suitable clamping means for retaining the bag attached to the perpendicular member and to hold the bag in an open position.

In a third embodiment of the present invention, the outwardly extending perpendicular member may have a recess such that a liner, having magnetic attraction properties, may then be placed within the recess and between the triangularly shaped sides so that stray cutting particles can not escape from the receptacle apparatus. Alternatively, a liner of low-density fabric cloth may be used and could prove to be a better choice for particles that are not entirely metallic in nature, e.g. wood or plastic, which could be mixed in with metal cuttings as well.

Currently, there is a need in the field for a reusable, portable, and multipurpose cuttings receptacle that can be used in several orientations and can provide a substantive alternative to obsolete and unnecessarily cumbersome methods. An example of a bag that is unmanageable to use, principally due to it's design, is that of U.S. Pat. No. 4,139,037 [McGuigan], which teaches about a bag for collecting waste material from a cutting machine. The bag is designed with an optional drawstring to reduce the circumference of the open end so that it can fit more securely around the cutting machine area. Alternatively, the bag could be much larger and fit semi-permanently under the table via hooks, which pass through grommets positioned in the corners at the upper open end of the bag. The bag of McGuigan could also be sealed to the sides of the table preferably by use of magnetic tape, double sided adhesive tape or VELCRO®. The bag also relies almost entirely on the support of the floor to remain in an upstanding position and must be custom designed based on the dimensions of the tables, so it is often impossible to successfully transfer the bag to other machines for use.

The present invention, however, overcomes the considerable setbacks of the McGuigan's invention by providing a portable receptacle that may be attached on practically any type of machinery or other metallic surface by use of magnets for attachment means. The present invention is also self-sufficient in that it does not have to rest of the floor for support, as McGuigan's bag must. Further, unlike McGuigan, the present invention may be placed in any orientation because unmanageable size or design does not limit its range of use. Clearly, unlike the present invention, McGuigan teaches away from multi-purpose use of the bag as evidenced by the bulky design for use under a cutting table. Moreover, due to the present invention's advantageous size and design, the contents of the bag are more easily disposed of either by simply overturning the bag, or turning the bag inside-out, or dusting or tapping the particles off the liner, whereas McGuigan's invention requires the user to lift the cutting table and release all the hooks to detach the bag for disposal and then reattach the bag, which undoubtedly proves to be a lengthy and cumbersome undertaking. The present invention also provides the optional use of a magnetized liner for use in a recessed tray to attract the particles away from the structure surface, which McGuigan does not teach or even suggest.

An example of a non-reusable bag is U.S. Pat. No. 5,915,839 [Dennis], which teaches a dust bag or collection system that includes a generally vertical receptacle in the form of a pleated bag attached parallel to a vertical drill surface. The bag is attached and positioned below a hole to be drilled for the collection of particles from the surface being drilled. However, unlike the present invention, Dennis does not provide an apparatus that is capable of being used in several orientations because Dennis' invention assumes that all of the particles will fall in a downwards direction, clearly ignoring the particles that escape in other directions.

Further, Daniels does not teach the use of magnets for attachment to the structure so that the bag may be re-used, nor does Daniels teach of a magnetic liner to attract the metal particles away from the structure and into the receptacle to keep the surface clear of debris. In fact, Daniels teaches away from the novelty of the present invention by using adhesive strips clearly intended for one-time use of the bag and by designing a receptacle, which clearly can only be used effectively in one orientation. Moreover, the particles can not be disposed of without detaching the bag entirely from the wall and disposing of the entire container. Further, there is no structure described that retains the bag in an open position as taught in the present invention.

An example of a collection bag on a larger scale is U.S. Pat. No. 5,464,286 [Stevens et al.], which discloses a ceiling dust and debris collection system for use with suspended ceilings. A large flexible bag is attached by taping means to an opening where a rectangular ceiling tile has been removed. The bag contains a rectangular opening to be attached around the perimeter of the ceiling where the tile had been removed and a circular opening with a drawstring that is attached around the waist of the human who is performing service in the ceiling area. As such, any debris will be caught in the somewhat cylindrical shaped bag. However, while this invention utilizes a type of bag collection system, it clearly does not resemble the present invention in its design, intended use or novelty.

Accordingly, it is an object of the present invention to overcome the setbacks associated with prior receptacle bags by providing a distinctive cuttings receptacle system that is portable and allows the consumer to use the collection system in many different orientations based on the type of the work being done.

It is another object of the present invention to provide a system that is re-usable and can be attached virtually anywhere via use of magnets around the planar support member of the present collection system. Thus, the system may be easily applied to any metallic surface and detached when finished and then re-applied elsewhere for continued use. Further, the collection bag, magnetic liner and cloth may be reused for an indefinite period of time as well and are designed so that minimal cleaning, if any, is required between uses.

It is yet a further object of the present invention to provide a system in which the receptacle is designed for easy disposal of accumulated particles. As such, the present system may be simply turned over so that the particles are allowed to fall through the circular aperture of the planar member and into the proper disposal receptacle. Alternatively, the particles may also be disposed of by merely dusting or tapping them off the magnetic or cloth liner in the recessed tray of the present invention.

SUMMARY OF THE INVENTION

The present invention provides a tangible solution to the considerable setbacks experienced with the prior inventions. More specifically, the present invention teaches an apparatus for catching and retaining metallic and other particles in a portable receptacle comprising a top planar support member with central circular aperture, having a plurality of magnets arranged on the upward facing surface for attachment of the apparatus to a metallic surface and a downwardly extending flexible collection bag that is attached to said planar member in an open position to catch and retain particles. The bottom planar member also has a circular aperture through which the particles may pass into a collection bag that is held in an open position between the attached bottom planar member and the top planar support.

In another embodiment of the present invention, the top planar member may contain a circular collar that distends downward from the circular aperture and is used for attaching the collection bag to the apparatus. The collection bag may be attached to the distending collar by cooperating fastening means attached to the inner surface of the opening of said collection bag and to the outer surface of said collar. Alternatively, the collection bag may be attached to the distending collar by a drawstring.

In yet another embodiment of the present invention, the apparatus could be comprised of two planar members, both having central openings, attached at right angles to each other, with one of the members containing an array of magnets for attachment of the receptacle to a central surface and the other member, to which a collection means is attached, extending outwards from the metal surface. A pair of triangular supports are then attached between the two planar members to prevent sideways escape of particles. A bottom planar member is attached to the horizontal planar member for capturing and retaining the collection means against the horizontal member. The horizontally extending member has a central aperture with a downwardly produced recess within which particles are collected. Within this downward recess is a collection means, i.e., magnetic liner or low density cloth, which are retained between the bottom and horizontal members, for attracting and catching particles through the aperture in the horizontal member.

BRIEF DESCRIPTION OF THE DRAWINGS

For the purpose of illustrating the invention, there is shown in the drawings forms that are presently preferred; it being understood, however, that the invention is not limited to the precise arrangements and instrumentalities shown.

Referring now to the drawings in detail, where like numerals refer to like parts or elements, there is shown.

DETAILED DESCRIPTION OF THE PREFERRED EMBODIMENTS

The following detailed description is of the best presently contemplated mode of carrying out the invention. The description is not intended in a limiting sense, and is made solely for the purpose of illustrating the general principles of the invention. The various features and advantages of the present invention may be more readily understood with reference to the following detailed description taken in conjunction with the accompanying drawings.

Figure 1:
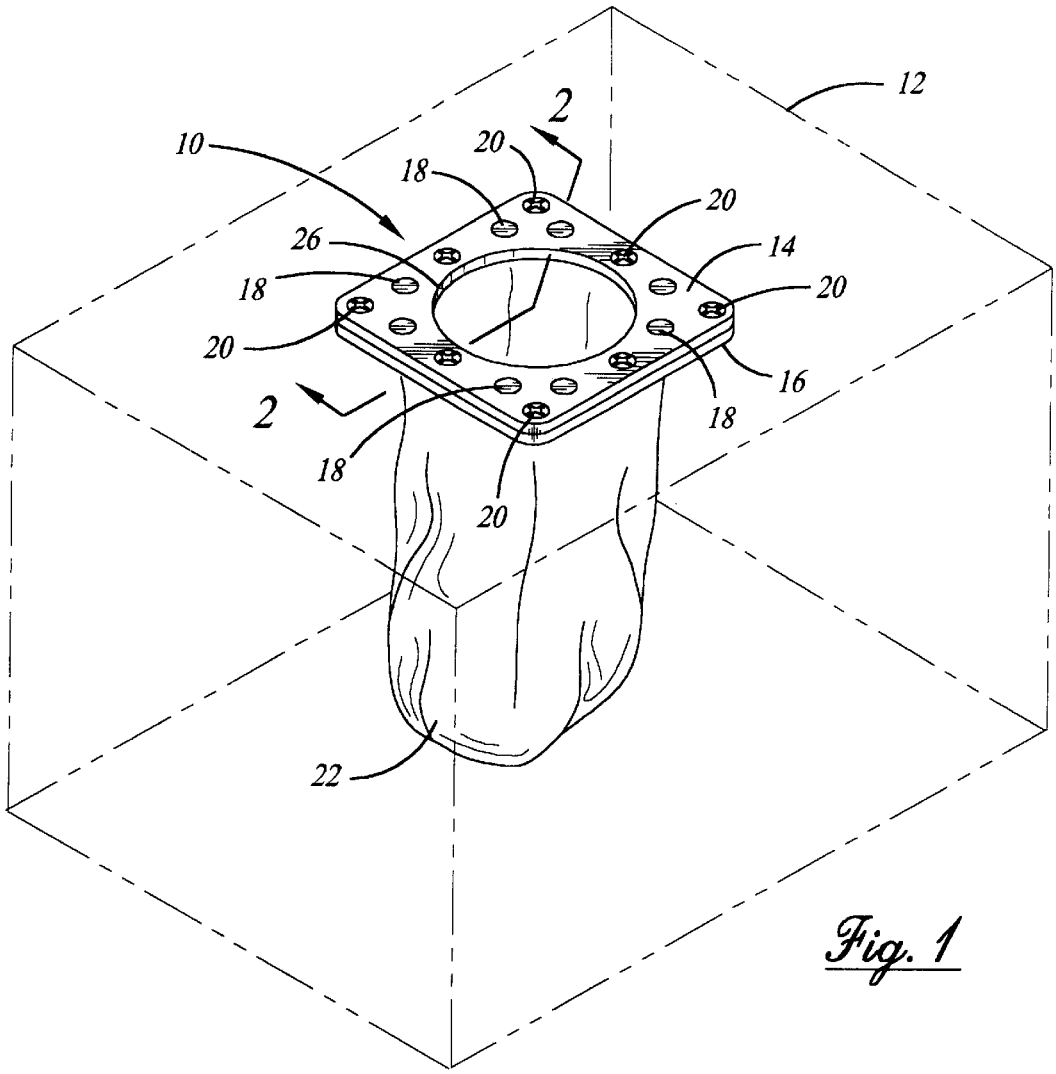
FIG. 1 is a perspective view of a first embodiment of the present invention showing attachment to a surface above.

FIG. 1 shows a first embodiment of the specialty metal cuttings receptacle 10, which is attached to the top undersurface 12 of a container shown in dashed lines. Receptacle 10 is comprised essentially of a top planar support member 14 and is attached to bottom planar support member 16 via screws 20. Top planar support member 14 contains magnets 18 that are used to affix receptacle 10 to a metal surface. Receptacle 10 is placed over the drill, punch or cut area such that center of the cutting area is aligned with the center of open circular aperture 26 so that the particles will fall into the downwardly extending collection bag 22. Collection bag 22 may be constructed of a tightly woven cloth, or the like.

Figure 2:
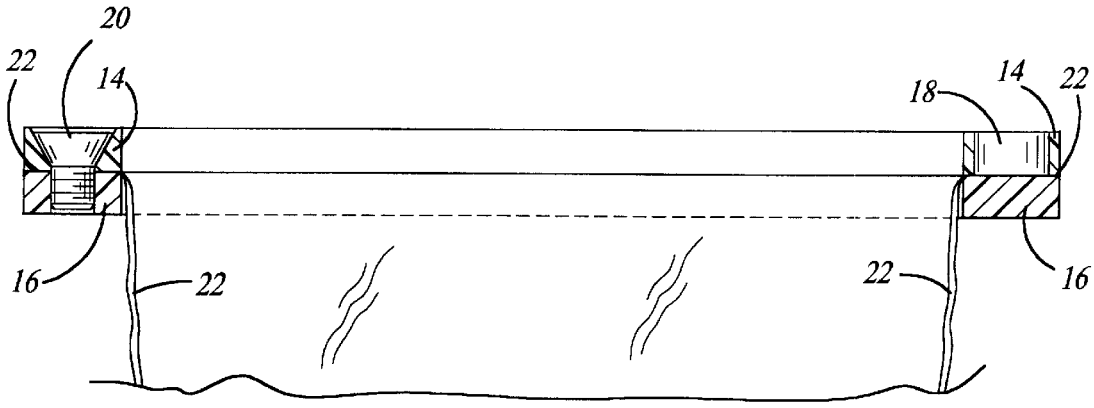
FIG. 2 is a sectional view taken along Line 2—2 of FIG. 1.

As shown more specifically in FIG. 2, collection bag 22 is attached between the top planar support member 14 and the bottom planar support member 16. The bag material is kept securely in place and in an open position between the two surfaces via the tightened screws 20. It is to be understood that although eight screws and eight magnets are shown in FIG. 1, that any variation in size, shape or placement of the magnets and screws would be acceptable and within the scope and spirit of the present invention. To dispose of the particles and remnants from bag 22, receptacle 10 may simply be turned over or turned inside out so that the particles can fall through circular aperture 26 and into the proper trash or recycling container. Bottom member 16 and top member 14 may be unscrewed, therefore releasing bag 22 from between them so that bag 22 may be cleaned more thoroughly or eventually replaced and any remaining particles within can then be disposed of.

Figure 3:
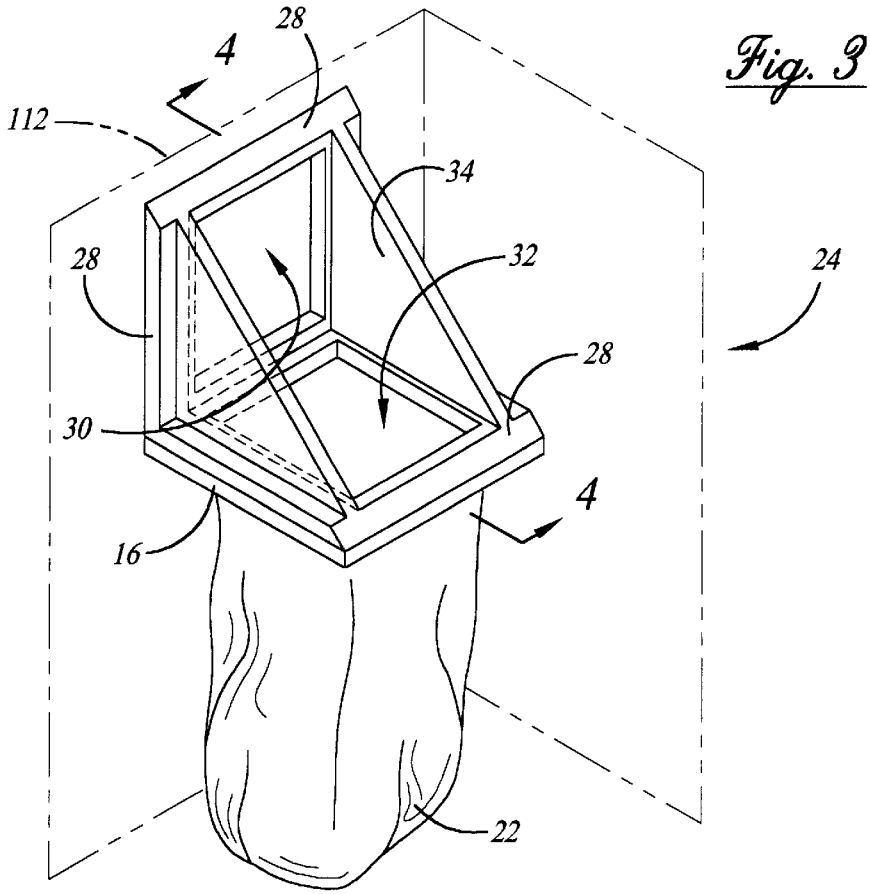
FIG. 3 is a perspective view of a second embodiment of the present invention showing attachment to a vertically upstanding wall with downwardly extending collection bag.
Figure 4:
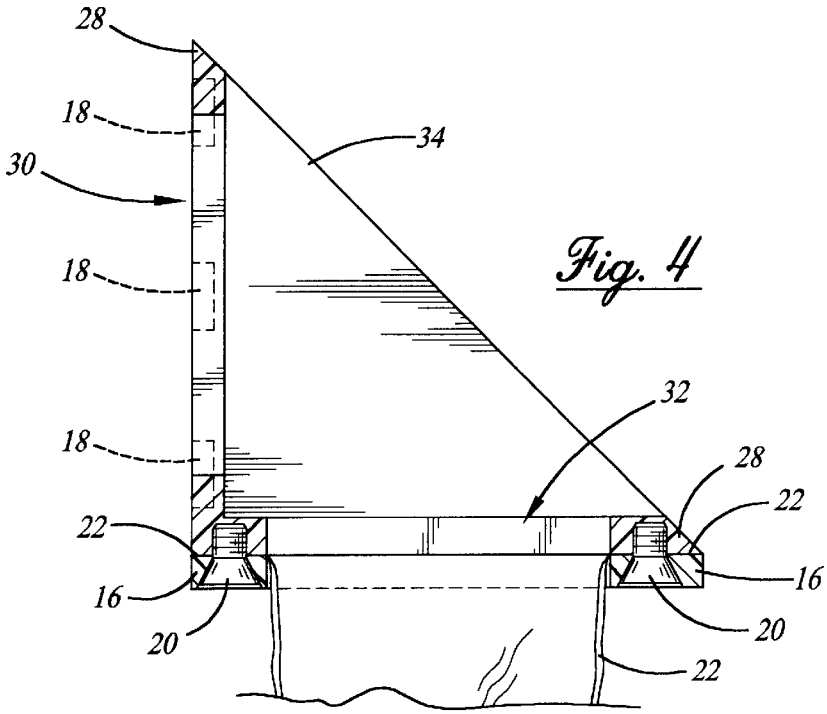
FIG. 4 is a sectional view taken along Line 4—4 of FIG. 3.

In a second embodiment of the present invention, FIG. 3 shows another or metal filings collection apparatus 24 attached to vertically upstanding wall 112. Receptacle attachment 28 is positioned against the vertically upstanding wall 112 around an open drill, punch, or cutting area 30 and held in place by magnets 18 attached to the support 28, as better shown in FIG. 4. Two solid triangular panels 34 join the vertical and horizontal sections of support 28 in a perpendicular orientation. The triangular panels 34 also aide in preventing the particles from escaping sideways during use of the collection apparatus 24. Receptacle support 28 is attached to bottom planar support member 16 to securely retain collection bag 22 between the support 28 and planar member 16 via screws 20, creating a square or rectangular opening 32 for the particles to fall through. In accordance with the present invention, any shape, size or orientation variation of attachment support 28 would be acceptable and fall within the scope of the invention. As recited above, the contents within the bag may be removed by either turning the entire attachment 28 over into the trash or the bag may be removed from attachment 28 and bottom member 16 by unscrewing the screws and disposing of the contents in bag 22 accordingly.

Figure 5:
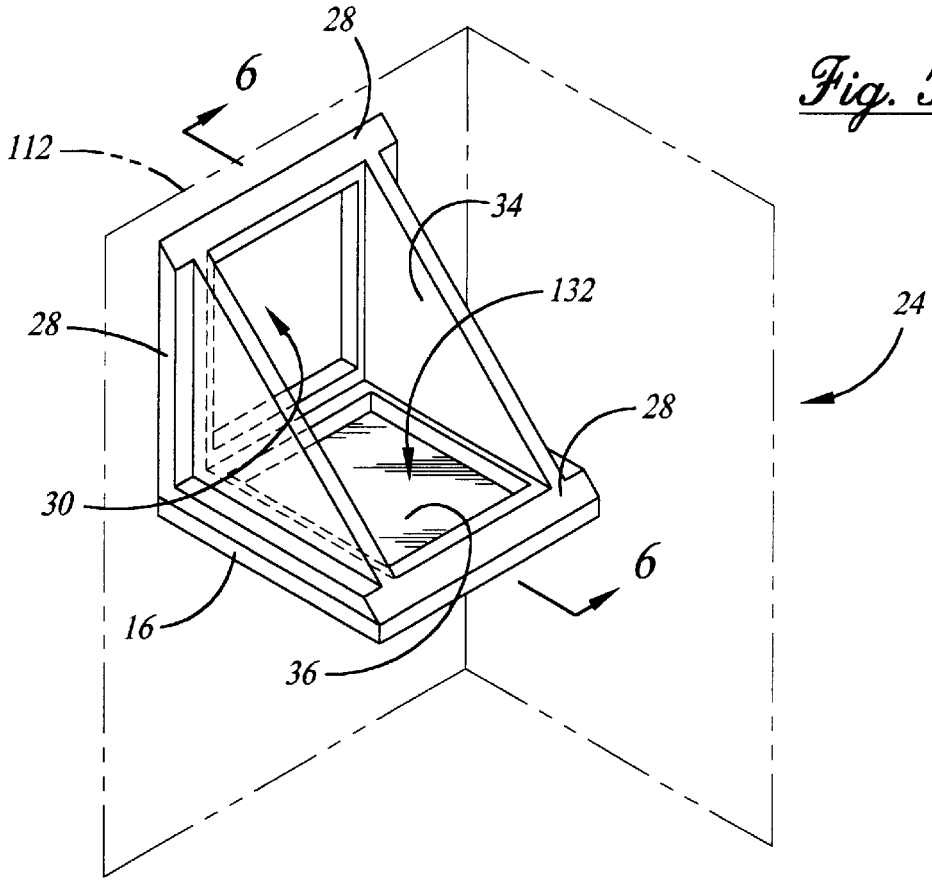
FIG. 5 is a perspective view of a third embodiment of the present invention showing attachment to a vertically upstanding wall with magnetized collection sheet.
Figure 6:
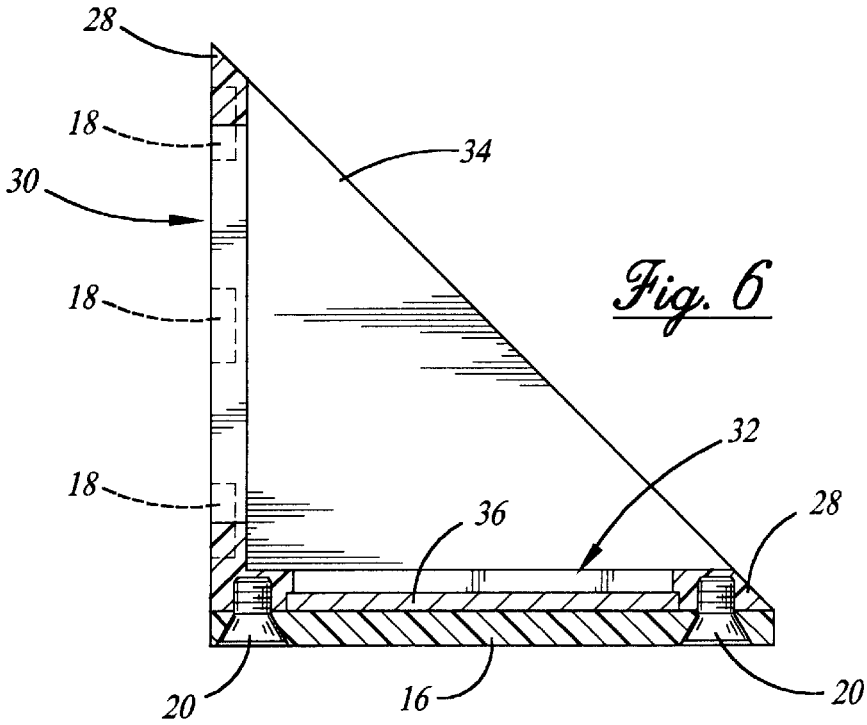
FIG. 6 is a sectional view taken along Line 6—6 of FIG. 5.

Alternatively, FIG. 5 shows another embodiment of modified receptacle 24. Attachment 28 is shown affixed to vertical upstanding wall 112 directly around drill, cut or punch opening 30 by way of magnets 18 as shown in FIG. 6. However, instead of bag 22 being used to catch the particles, a planar magnetic flexible liner 36 is attached within a recess 132 of the upward facing portion of bottom member 16. Bottom member 16 with liner 36 is then fastened to horizontal portion of supports 28 via screws 20 such that magnetic liner 36 fits into the open recess 132. Magnetic liner 36 is especially useful in that it attracts the magnetic particles, i.e. cuttings, filings, directly to it and works well in conjunction with triangular solid walls 34 in collecting the drill, punch and cut particles. Moreover, since liner 36 attracts magnetic particles, it also helps to keep cutting area free of debris and remnants that may impede further cutting. To remove the particles from magnetic liner 36, the attachment 28 may simply be removed from the wall and the particles dusted or tapped into the trash or recycle container. Bottom member 16 may be easily unscrewed from attachment 28 for more thorough cleaning of the liner 36.

Figure 7:
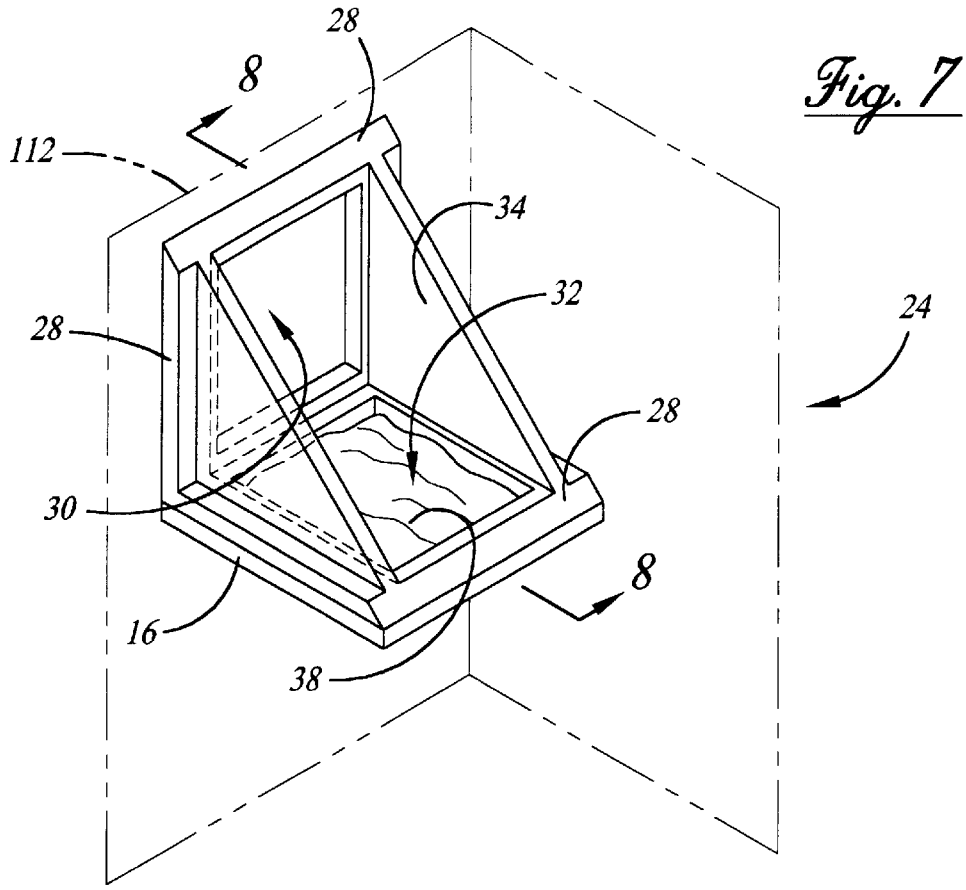
FIG. 7 is a perspective view of a fourth embodiment of the present invention showing attachment to a vertically upstanding wall with fabric collection sheet.
Figure 8:
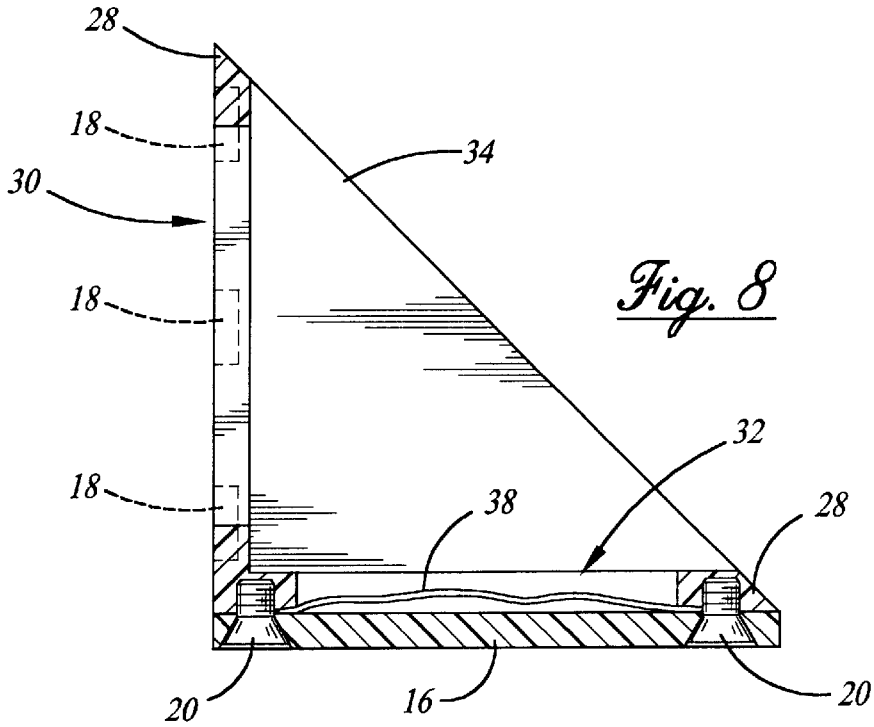
FIG. 8 is a sectional view taken along Line 8—8 of FIG. 7.

FIGS. 7 and 8 show a fourth embodiment of collection receptacle 24. Support 28 is attached to upstanding wall 112 with bottom member 16, supporting within a recess 32, a low-density fabric collection sheet 38. Attachment 28 is directly attached to the wall 112 overlying drill or cut area via magnets 18 so that opening 30 corresponds with the cut area. Triangular sidewalls 34 direct stray particles and debris inward and down to the fabric liner 38. Bottom member 16 is attached to support 28 via screws 20 and the outer perimeter of fabric 38 is securely fastened between member 16 and the horizontal section of support 28 as shown in FIG. 8. The use of fabric is a good choice for instances where the debris is not entirely metallic in nature, e.g. wood or plastic. The fabric also serves to keep the debris in place on the fabric 38 and within the recess 32 of bottom member 16 because it creates a surface with considerable friction. However, the debris and particles on the fabric may be easily removed by removing support 28 from wall 112 and turning it over into a trash or recycling receptacle and dusting or tapping off the area. The fabric may also be removed for more thorough cleaning by unscrewing attachment 28 and bottom member 16, thereby releasing fabric 38, to dispose of any remaining particles. Fabric 38 may then be easily reinserted between member 16 and support 28 and retained in position by screws 20 for further utilization of collection receptacle 24.

Figure 9:
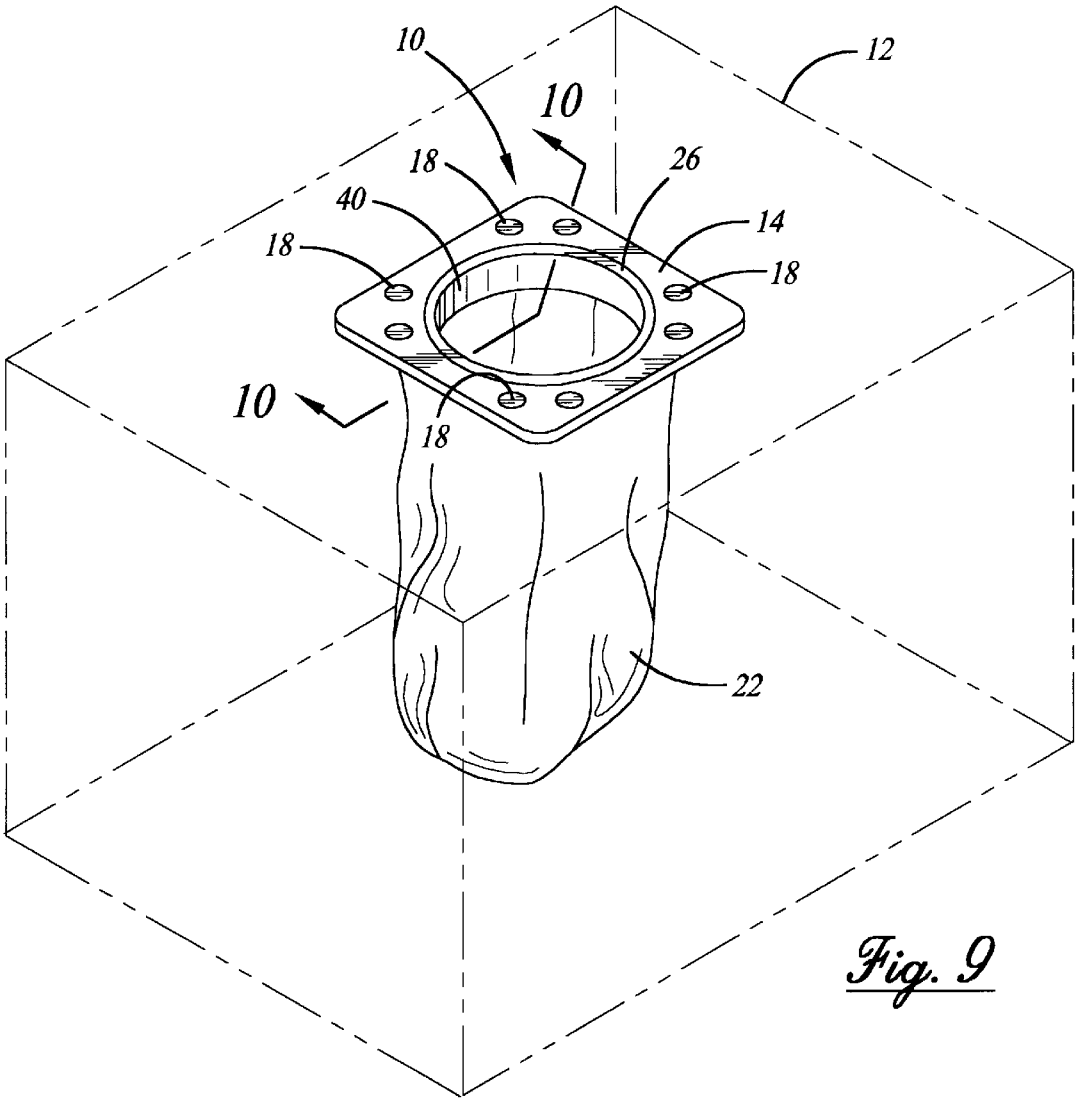
FIG. 9 is a perspective view of a fifth embodiment of the present invention showing attachment to a surface above with downwardly extending bag being secured to the collar via releasably securing means.
Figure 10:
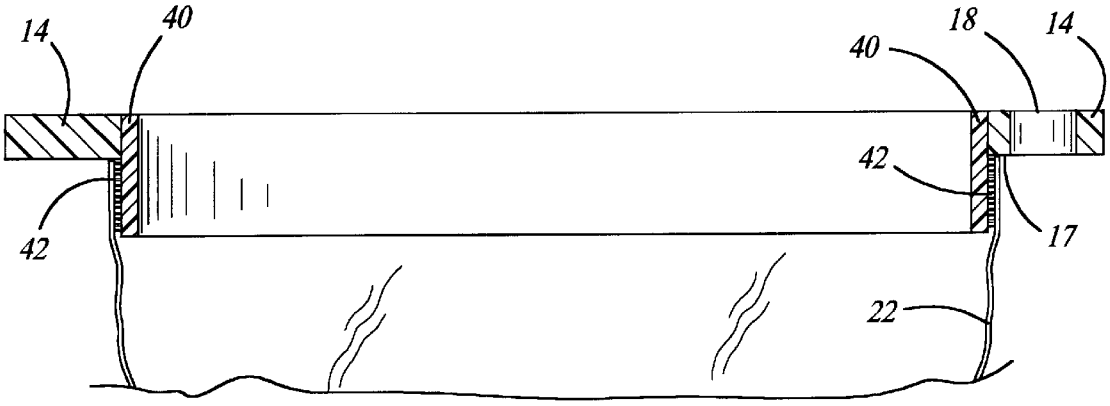
FIG. 10 is a sectional view taken along Line 10—10 of FIG. 9.
Figure 11:
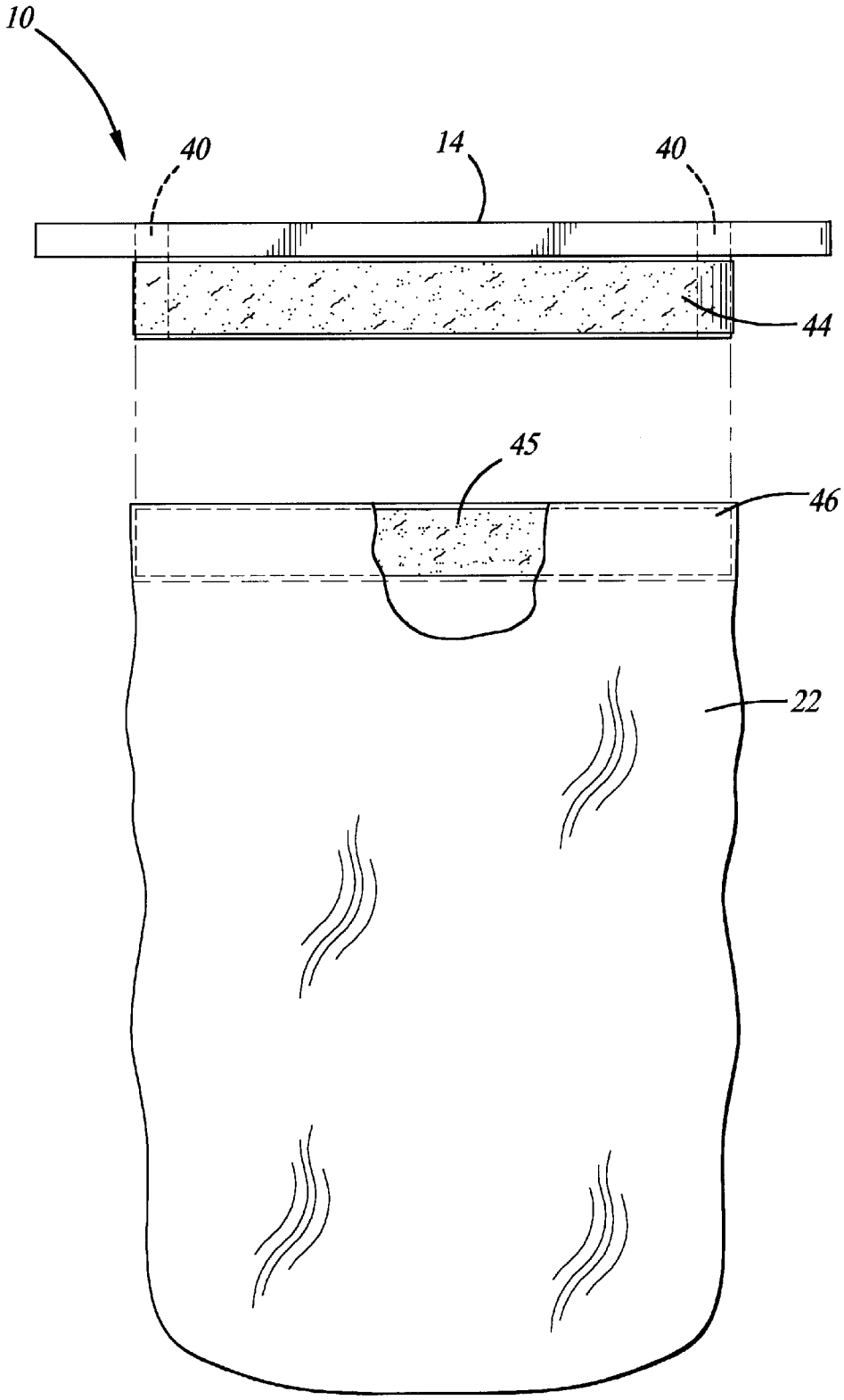
FIG. 11 is an exploded side view of the collar and top planar member with the collection bag separated therefrom.

FIGS. 9, 10, and 11 show a fifth embodiment of the present invention. Top member 14 is configured with a distending circular collar 40 forming a circular aperture 26 for the particles to fall through. Collection bag 22 is then attached to downwardly extending collar 40 by releasable attachment means 42, e.g. drawstring (not shown) or hook and loop fasteners as shown in FIGS. 10 and 11. Referring to FIGS. 10 and 11 the outer surface of distending collar 40 supports a strip of looped fabric 44 that interfaces with a strip of hooked fabric 45 along the inner surface of the opening 46 of bag 22, which can then be releasably fastened together. Thus, the bag can be removed from the collar by pulling collar 40 and bag 22 apart, as shown more specifically in FIG. 11, and the contents in bag 22 may be easily disposed of. However, it is to be understood that any releasable attachment means may be used and although hook and loop fastening is shown, it is by way of example and is not intended in a limiting sense.

The present invention may be embodied in other specific forms without departing from the spirit or essential attributes thereof and, accordingly, the described embodiments are to be considered in all respects as being illustrative and not restrictive, with the scope of the invention being indicated by the appended claims, rather than the foregoing detailed description, as indicating the scope of the invention as well as all modifications which may fall within a range of equivalency which are also intended to be embraces therein.

I claim:

1. An apparatus for catching and retaining metallic and other particles in a portable receptacle comprising:

a top planar support member with central circular aperture, having a plurality of magnets arrayed on the upward facing surface such that said support may be attached securely to a metallic surface;

a bottom planar support and retention member having a circular aperture coextensive with said aperture of said top planar member;

a downwardly extending flexible collection bag attached between said planar members and extending through the aperture in said bottom planar member in an open position for catching and retaining particles.

2. An apparatus for catching and retaining metallic and other particles in a portable receptacle comprising:

a planar support member with central circular aperture, having a plurality of magnets arrayed on the upward facing surface such that said support may be attached securely to a metallic surface;

a downwardly extending flexible collection bag attached to a circular collar distending from said circular aperture of said planar member for holding said collection bag in position for catching and retaining particles, said collection bag being releasably secured to an outer surface of said distending collar by cooperating fastening means attached to an inner surface of the opening of said collection bag and to the outer surface of said collar.

3. An apparatus for catching and retaining metallic and other particles in a portable receptacle comprising:

two planar members having central openings attached along a common edge and at right angles to each other, with one of the members containing an array of magnets for attachment of the receptacle to a vertical surface and the other member, to which a collection means is attached, extending perpendicularly outward from the vertical surface;

a pair of triangular supports attached between and at the sides of the perpendicularly oriented members to prevent sideways escape of particles; and a bottom planar member attached to the horizontal planar member for capturing and retaining the collection means between said members.

4. The apparatus of claim 3 wherein said horizontally extending member has a central aperture producing a recess within which particles are collected.

5. The apparatus of claim 3 wherein the collection means is extending downwardly from a central opening formed in said horizontal and bottom members.

6. The apparatus of claim 3 wherein the collection means is a magnetic liner, which is retained between said bottom and horizontal members for attracting and catching particles through the aperture in the horizontal member.

7. The apparatus of claim 3 wherein said collection means is a low-density cloth liner retained between said bottom and horizontal members for catching particles falling through the aperture in said horizontal member.

* * * * *